US008671487B2

(12) United States Patent
Dewell

(10) Patent No.: US 8,671,487 B2
(45) Date of Patent: Mar. 18, 2014

(54) AIR MATTRESS HAVING ONLY TWO INFLATE/DEFLATE PORTS FOR INFLATING FOUR OR SIX SEPARATE BLADDERS

(76) Inventor: Douglas Allen Dewell, Mission Viejo, CA (US)

( * ) Notice: Subject to any disclaimer, the term of this patent is extended or adjusted under 35 U.S.C. 154(b) by 346 days.

(21) Appl. No.: 13/229,839

(22) Filed: Sep. 12, 2011

(65) Prior Publication Data

US 2013/0061399 A1 Mar. 14, 2013

(51) Int. Cl.
*A47C 27/10* (2006.01)

(52) U.S. Cl.
USPC ..... 5/710; 5/713

(58) Field of Classification Search
USPC ..... 5/644, 706, 710, 712, 713, 654, 655.3; 137/223, 231–233, 255, 262, 265, 594, 137/595
See application file for complete search history.

(56) References Cited

U.S. PATENT DOCUMENTS

| | | | | | |
|---|---|---|---|---|---|
| 388,037 | A * | 8/1888 | Name not available | ..... | 5/708 |
| 2,241,847 | A * | 5/1941 | Eberhard et al. | ..... | 137/223 |
| 3,303,518 | A * | 2/1967 | Ingram | ..... | 5/710 |
| 3,959,835 | A * | 6/1976 | Nos | ..... | 5/706 |
| 4,986,738 | A * | 1/1991 | Kawasaki et al. | ..... | 417/304 |
| 5,105,488 | A * | 4/1992 | Hutchinson et al. | ..... | 5/710 |
| 6,037,723 | A * | 3/2000 | Shafer et al. | ..... | 318/6 |
| 6,047,423 | A * | 4/2000 | Larson | ..... | 5/709 |
| 6,112,350 | A * | 9/2000 | Larson | ..... | 5/710 |
| 6,202,239 | B1 * | 3/2001 | Ward et al. | ..... | 5/727 |
| 6,684,434 | B2 * | 2/2004 | Ellis et al. | ..... | 5/713 |
| 6,763,540 | B1 * | 7/2004 | Wang | ..... | 5/710 |
| 7,181,795 | B2 * | 2/2007 | Wu | ..... | 5/710 |
| 7,234,183 | B2 * | 6/2007 | Elrod et al. | ..... | 5/699 |

* cited by examiner

*Primary Examiner* — Nicholas Polito
(74) *Attorney, Agent, or Firm* — Oakwood Law Group, LLP

(57) ABSTRACT

The invention relates generally to a multi-bladder air mattress where only two inflation-deflation port members are required to inflate an air mattress having either four or six separate air bladders.

20 Claims, 2 Drawing Sheets

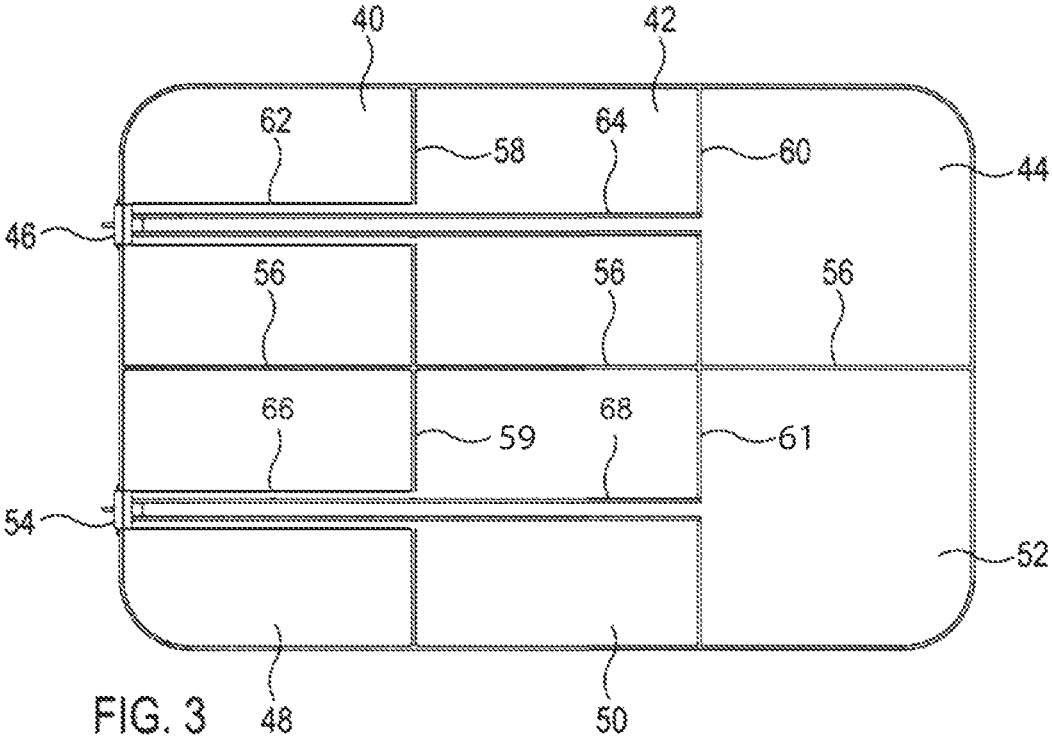
FIG. 3
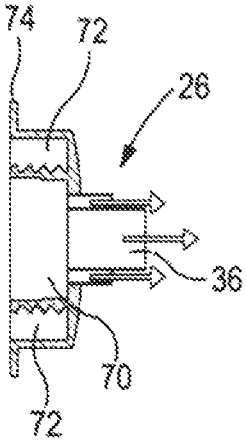
FIG. 4A
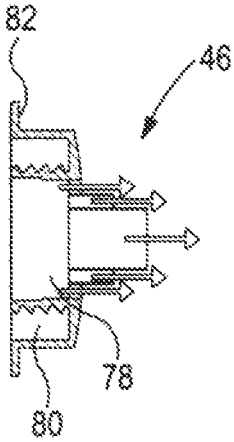
FIG. 4B
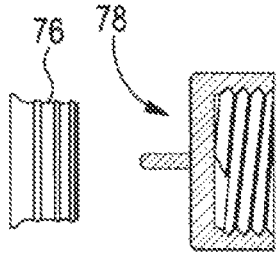
FIG. 4D
FIG. 4E
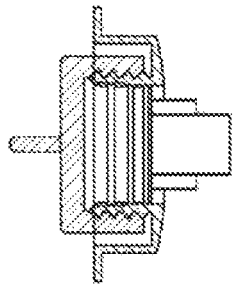
FIG. 4F
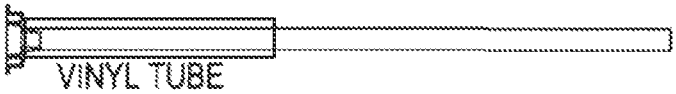
FIG. 4C

AIR MATTRESS HAVING ONLY TWO INFLATE/DEFLATE PORTS FOR INFLATING FOUR OR SIX SEPARATE BLADDERS

BACKGROUND OF THE INVENTION

1. Field of the Invention

The invention relates generally to an inflatable air mattress, and more particularly to a multi-bladder air mattress where only two inflation-deflation port members are required to inflate an air mattress having either four or six separate air bladders.

2. Description of Related Art

Air mattress are known in the prior art. More specifically, by way of example, U.S. Pat. No. 7,234,183 to Elrod, et al. discloses a fluid pressurizable multiple chamber mattress wherein each chamber is capable of operably receiving and releasing a fluid and at least one fluid valve for permitting the pressurization and depressurization of at least one fluid pressurizable chamber.

U.S. Pat. No. 7,181,795 to Wu discloses an inflatable bed having first and second chambers where air from the first chamber enters the second chamber through a unidirectional air inlet unit.

U.S. Pat. No. 6,684,434 to Ellis, et al. discloses a mattress assembly for supporting a patient where a control module is configured to supply air to first and second air zones to maintain the first air zone at a substantially constant first pressure and a second zone at a constant second pressure which is less than the first pressure to provide reduced pressure on a patient's calves and feet located on the second air zone.

U.S. Pat. No. 6,202,239 to Ward, et al. discloses a multi-zone support having a top foam layer, a middle foam layer, and a bottom foam layer where the resistance to a compressing force increases per layer from top to bottom. The middle layer incorporates five zones of support. Three of the zones include a sinusoidal surface for supporting the head/shoulder, hips, and legs/feet while the other two zones include a sold surface for supporting the back and thighs.

U.S. Pat. No. 6,112,350 to Larson discloses an air mattress having a low pressure bag with a size and shape to support a person during rest. A high pressure bag is adapted for inflation to a pressure higher than that of the low pressure bag and is of a size and shape to provide posture support as desired. An enclosure shell encloses the high and low pressure bags with the second high pressure bag being disposed below the low pressure bag and at approximately the longitudinal center of the low pressure bag.

U.S. Pat. No. 6,047,423 to Larson discloses a fluid-filled mattress with firmness adjusting air bladders where the individual bladders may be individually inflated and deflated to provide precise firmness adjustment.

U.S. Pat. No. 6,037,723 to Shafer, et al. discloses an automatic control system for controlling the firmness of an air mattress where the air control system provides for independent control of both bladders in a two bladder air mattress from a single unit, and allows a user to consistently set the firmness of each mattress air bladder to a desired value.

U.S. Pat. No. 5,105,488 to Hutchinson, et al. discloses various air chambers, cylinders, and tubes for use in the central or "lumbar" portions of the mattresses which may be selectively inflated or deflated in order to provide corresponding firmness levels. In an embodiment a body support has an array of barrel-shaped coils that define elongate gaps at their top and bottom portions, with an elongate, inflatable tube positioned in the gaps defined in the top portion of the body support.

U.S. Pat. No. 4,986,738 to Kawasaki, et al. discloses a housing containing an air pump and an air pressure supply system for supplying air to an air mattress. The housing contains, in addition to the air pump, diaphragm type pressure regulators and diaphragm type surge check valves, as well as passageways and pressure chambers for interconnecting the pump to the pressure regulators and surge check valves.

SUMMARY OF THE INVENTION

In an exemplary embodiment of the present invention, there is disclosed an air mattress comprising:

- a first set of first and second separate bladders aligned end to end along the length of the air mattress each with a width equal to a first half of the width of the air mattress;
- a first inflation-deflation port member attached to the first separate bladder of the first set;
- a tube having a first end attached to the first inflation-deflation port member which passes through the first bladder to feed air directly to the second bladder;
- a first set of air openings located in the inflation-deflation port member around the perimeter of the first end of the tube which feeds air directly to the first bladder
- a second set of first and second separate bladders aligned end to end along the length of the air mattress each with a width equal to the second half of the width of the air mattress;
- a second inflation-deflation port member attached to the first separate bladder of the second set;
- a tube having a first end attached to the second inflation-deflation port member which passes through the first bladder of the second set to feed air directly to the second bladder; and
- a first set of air openings located in the second inflation-deflation port member around the perimeter of the first end of the tube which feeds air directly to the first bladder.

In another exemplary embodiment of the present invention, there is disclosed an air mattress comprising:

- a first set of first, second and third separate bladders aligned end to end along the length of the air mattress each with a width equal to a first half of the width of the air mattress;
- a first inflation-deflation port member attached to the first separate bladder of the first set;
- a first tube having a first end attached to the first inflation-deflation port member which passes through the first and second bladders to feed air directly to the third bladder;
- a second tube located concentrically around the first tube having a first end attached to the first inflation-deflation port member which passes through the first bladder to feed air directly to the second bladder;
- a set of air openings located in the inflation-deflation port member around the perimeter of the end of the second tube to feed air directly to the first bladder;
- a second set of first, second and third separate bladders aligned end to end along the length of the air mattress each with a width equal to the second half of the width of the air mattress;
- a second inflation-deflation port member attached to the first separate bladder of the second set;
- a first tube having a first end attached to the second inflation-deflation port member which passes through the first and second bladders to feed air directly to the third bladder;
- a second tube located concentrically around the first tube having an end attached to the second inflation-deflation port member which passes through the first bladder to feed air directly to the second bladder; and a set of air openings located in the second inflation-deflation port member around the perimeter of the end of the second tube to feed air directly to the first bladder.

The more important features of the invention have thus been outlined in order that the more detailed description that follows may be better understood and in order that the present contribution to the art may better be appreciated. Additional features of the invention will be described hereinafter and will form the subject matter of the claims that follow.

Before explaining at least one embodiment of the invention in detail, it is to be understood that the invention is not limited in its application to the details of construction and the arrangements of the components set forth in the following description or illustrated in the drawings. The invention is capable of other embodiments and of being practiced and carried out in various ways. Also it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

The foregoing has outlined, rather broadly, the preferred feature of the present invention so that those skilled in the art may better understand the detailed description of the invention that follows. Additional features of the invention will be described hereinafter that form the subject of the claims of the invention. Those skilled in the art should appreciate that they can readily use the disclosed conception and specific embodiment as a basis for designing or modifying other structures for carrying out the same purposes of the present invention and that such other structures do not depart from the spirit and scope of the invention in its broadest form.

BRIEF DESCRIPTION OF THE DRAWINGS

Other aspects, features, and advantages of the present invention will become more fully apparent from the following detailed description, the appended claim, and the accompanying drawings in which similar elements are given similar reference numerals.

FIG. 3 is a plan view of an air mattress with the top cover removed fabricated from vinyl with or without fabric reinforcement with welded seams having six bladders located side by side with one inflation-deflation port member per side where each inflation-deflation port member inflates three bladders in accordance with the principles of the invention;

FIG. 4A is a side sectional view of an inflation-deflation port member for a four bladder air mattress where the arrows show airflow through the inflation-deflation port member in accordance with the principles of the invention;

FIG. 4B is a side sectional view of an inflation-deflation port member for a six bladder air mattress where the arrows show airflow through the inflation-deflation port member in accordance with the principles of the invention;

FIG. 4C is a side view of a vinyl tube which is attached to the inflation-deflation port member where a single tube is used for each inflation-deflation port member for a four bladder air mattress and a tube having two concentrically positioned tubes is used for each inflation-deflation port member for a six bladder air mattress;

FIG. 4D is a side view of plug which is press fit into an inflation-deflation port member;

FIG. 4E is a sectional view of a cap which is threaded into an inflation-deflation port member; and FIG. 4F is a sectional view of the plug and cap assembled on an inflation-deflation port member.

DESCRIPTION OF THE PREFERRED EMBODIMENT

Figure 1:
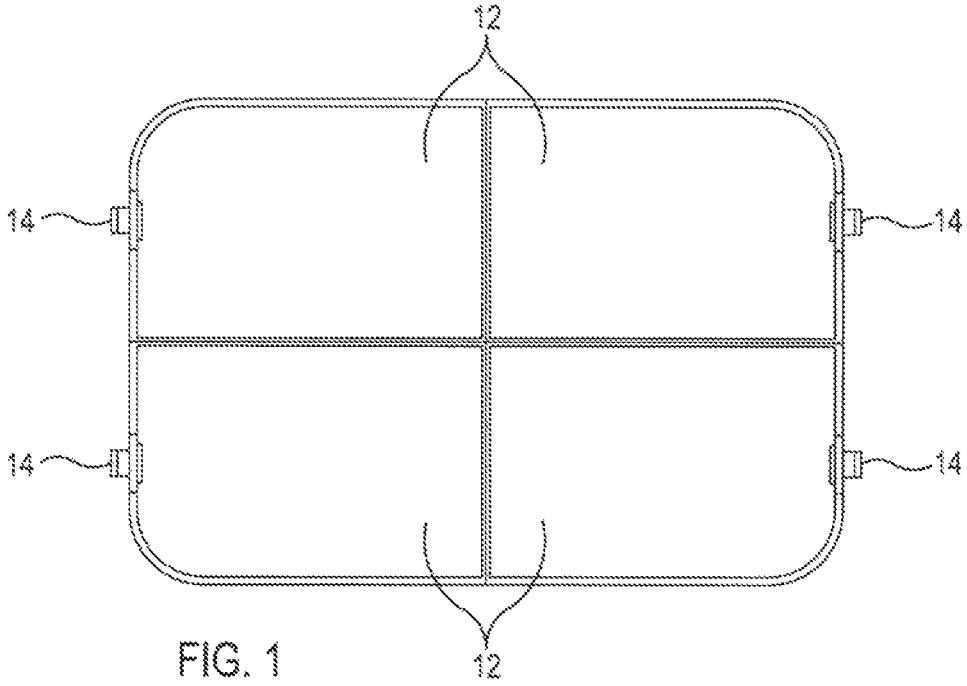
FIG. 1 PRIOR ART
FIG. 1 is a plan view of a prior art air mattress fabricated from vinyl with or without fabric reinforcement and with welded seams having four bladders and four fill ports.

Referring to FIG. 1, there is shown a plan view of a prior art air mattress 10 fabricated from vinyl with or without fabric reinforcement and with welded seams having four bladders 12 and four fill port members 14. To fill the air mattress a user attaches a small air pump to each fill port and fills each port separately to a desired pressure. Thus, when filling an air mattress a user must attach the air pump to each of four different air input ports and then either estimate or use an air pressure gauge to provide each of the bladders with the same air pressure.

Figure 2:
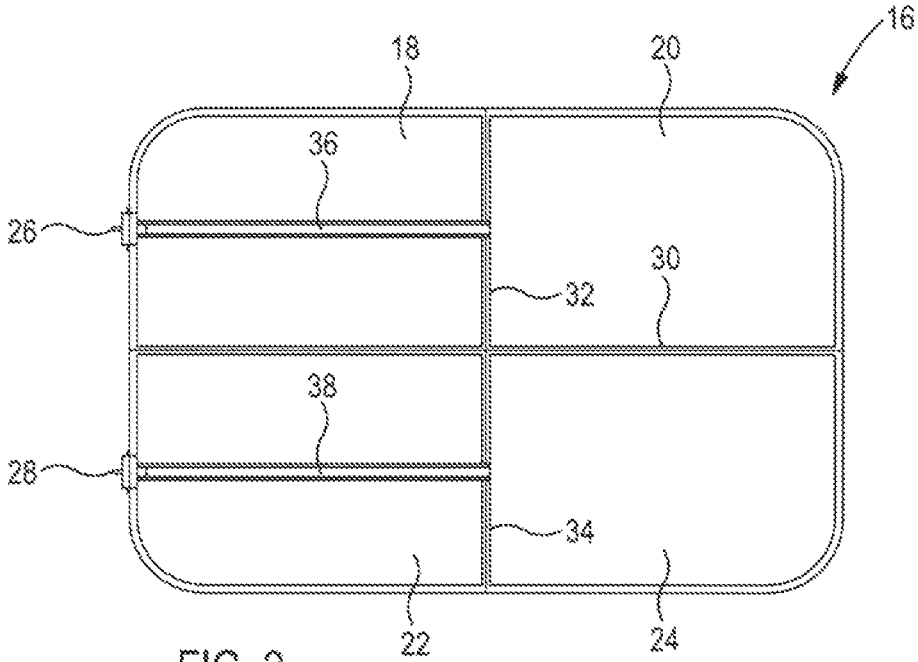
FIG. 2 is a plan view of an air mattress with the top cover removed fabricated from vinyl with or without fabric reinforcement with welded seams having four bladders located side by side and two inflation-deflation port members in accordance with the principles of the invention.

Referring to FIG. 2, there is shown a plan view of an air mattress 16 with the top cover removed which is fabricated from a vinyl plastic, with or without fabric reinforcement and with welded seams having four bladders 18, 20, 22, 24 and two inflation-deflation port members 26, 28 in accordance with the principles of the invention. The top cover may be made of a moisture absorption and reinforcement fabric.

Bladders 18, 20 are located along one side of the air mattress and each is connected to common inflation-deflation port member 26. Bladders 22, 24 are located along the other side of the air mattress and each is connected to common inflation-deflation port member 28. Bladders 18, 20 are separated and isolated from bladders 22, 24 with a vinyl divider 30 which prevents air in bladders 18, 20 from mixing with air in bladders 22, 24. Bladders 18, 20 are separated and isolated from each other with a vinyl divider 32, and bladders 22, 24 are separated and isolated from each other with a vinyl divider 34. Inflation-deflation port member 26 has ports which communicate directly with bladder 18 and additional ports which communicate with a vinyl tube 36 which feeds air to bladder 20. Thus, bladders 18, 20 which are separate and isolated from each other are filled with air at the same time and with the same air pressure from a common inflation-deflation port member 26.

In a similar manner bladders 22, 24 which are separate and isolated from each other with vinyl divider 34 communicate with an inflation-deflation port member 28. Inflation-deflation port member 28 has ports which communicate directly with bladder 22 and additional ports which communicate with vinyl tube 38 which feeds air to bladder 24. Thus, bladders 22, 24 which are separate and isolated from each other are filled with air at the same time and with the same air pressure from common inflation-deflation port member 28.

Referring to FIG. 3, there is shown a plan view of an embodiment of an air mattress with the top cover which may be made of a moisture absorption and reinforcement fabric. removed where the air mattress may be fabricated from vinyl with or without fabric reinforcement and with welded seams having six bladders, three along one side of the air mattress and three along the other side of the mattress, with only one inflation-deflation port member per side where each inflation-deflation port member inflates three bladders simultaneously with the same air pressure in accordance with the principles of the invention. Bladders 40, 42, 44 are located along one side of the air mattress and each bladder is connected to common inflation-deflation port member 46. Bladders 48, 50. 52 are located along the other side of the air mattress and each is connected to common inflation-deflation port member 54. Bladders 40, 42, 44 are separated and isolated from bladders 48, 50, 52 with a vinyl divider 56 which prevents air in bladders 40, 42, 44 from mixing with air in bladders 48, 50, 52. Bladders 40, 42, 44 are separated and isolated from each other with vinyl dividers 58, 60, and bladders 48, 50, 52 are separated and isolated from each other with vinyl dividers 59, 61. Inflation-deflation port member 46 has ports which communicate directly with bladder 40, other ports which communicate with an outer tube 62 of two concentric vinyl tubes which feeds air to bladder 42, and still other ports which communicate with an inner tube 64 of the concentric tubes which feeds air to bladder 44. Thus, bladders 40, 42, 44 which are separate and isolated from each other are filled with air at the same time with the same air pressure from common inflation-deflation port member 46.

In a similar manner bladders 48, 50, 52 which are separate and isolated from each other with vinyl dividers 58, 60 each communicates with inflation-deflation port member 54. Inflation-deflation port member 54 has ports which communicate directly with bladder 48, another port which communicate via an outer vinyl tube 64 of two concentric tubes which feeds air to bladder 50, and still other ports which communicate with an inner vinyl tube 66 of two concentric tubes which feeds air to bladder 52. Thus, bladders 48, 50, 52 which are separate and isolated from each other are filled with air at the same time and with the same air pressure from common inflation-deflation port member 54.

Referring to FIG. 4A, there is shown a side sectional view of an air inflation-deflation port member for the four bladder air mattress of FIG. 2 where the arrows show airflow through the air inflation-deflation port member to two separate bladders simultaneously in accordance with the principles of the invention. The inflation-deflation port member 26 has a double wall cup shaped member having two chambers 70, 72 and a flange 74 which is adapted to be securely attached to a side of an air mattress with thermal welding, thermal bonding or other suitable method. Inner chamber 70 communicates with vinyl tube 36, see FIG. 2, which passes through bladder 18 and communicates with bladder 20. Inner chamber 70 also includes air passageways which are located around the perimeter of the tube 36 and which communicate with the bladder 18. Thus, in operation, an air pump which is attached to the air inflation-deflation port member 26 will supply pressurized air to separate and isolated bladders 18, 20 simultaneously until each bladder is filled with air at the same pressure. When bladders 18, 20 are filled with air at the desired air pressure, the air pump is removed and a plug 76, see FIG. 4D, which may be made of rubber or a fluoro-elastomer material is press fit into chamber 70 to prevent air from exiting bladders 18, 20. To complete the air seal, a cap 78, see FIG. 4E, which can be made of a polymer material is threaded onto the outside surface of the wall which forms the inner chamber 70. See FIG. 4F which shows a sectional view of the plug and cap assembled on the inflation-deflation port member 26. In a similar manner, bladders 22, 24 of the four bladder air mattress are simultaneously filled with pressurized air. Thus, with only two inflation-deflation port members, four bladders are filled with pressurized air.

Referring to FIG. 4B, there is shown a side sectional view of an air inflation-deflation port member for the six bladder air mattress of FIG. 3 where the arrows show airflow through the air inflation-deflation port member to three separate bladders simultaneously in accordance with the principles of the invention. The inflation-deflation port member 46 has a double wall cup shaped member having two chambers 78, 80 and a flange 82 which is adapted to be securely attached to a side of an air mattress with thermal welding, thermal bonding or other suitable method. Inner chamber 78 communicates with vinyl tube 64, see FIG. 3, which is the inner tube of two concentrically located tubes which passes through bladders 40, 42 and communicates with the last bladder 44. Inner chamber 78 also includes air passageways which are located around the outside of the perimeter of the inner tube 64 which communicate with tube 62 which is the outside tube of the two concentrically located tubes which passes through bladder 40 and communicates with the middle bladder 48. Inner chamber 78 includes additional air passageways which are located around the outside of the perimeter of the outer tube 62 which is the outside tube of the two concentrically located tubes to communicate with the first bladder 40. Thus, in operation, an air pump which is attached to the air inflation-deflation port member 46 will supply pressurized air to separate and isolated bladders 40, 42, 44 simultaneously until each of the three bladders are filled with air at the same pressure. When the three bladders 40, 42,44 are filled with air at the desired air pressure, the air pump is removed and a plug 76, see FIG. 4D, which may be made of rubber or a fluoro-elastomer material is press fit into chamber 78 to prevent air from exiting bladders 40, 42, 44. To complete the air seal, a cap 78, see FIG. 4E, which can be made of a polymer material is threaded onto the outside surface of the wall which forms the inner chamber 78. See FIG. 4F which shows a sectional view of the plug and cap assembled on the inflation-deflation port member 46. In a similar manner, bladders 48, 50, 52 of the six bladder air mattress are simultaneously filled with pressurized air. Thus, with only two inflation-deflation port members, six bladders are filled with pressurized air.

Referring to FIG. 4C, there is shown a side view of a vinyl tube which is attached to the inflation-deflation port member where a single tube is used for each inflation-deflation port member for a four bladder air mattress and a tube having two concentrically positioned tubes is used for each inflation-deflation port member for a six bladder air mattress In another embodiment of the invention the tube having two concentrically positioned tubes can be replaced with two tubes which are located side by side.

While there have been shown and described and pointed out the fundamental novel features of the invention as applied to the preferred embodiments, it will be understood that the foregoing is considered as illustrative only of the principles of the invention and not intended to be exhaustive or to limit the invention to the precise forms disclosed. Obvious modifications or variations are possible in light of the above teachings. The embodiments discussed were chosen and described to provide the best illustration of the principles of the invention and its practical application to enable one of ordinary skill in the art to utilize the invention in various embodiments and with various modifications as are suited to the particular use contemplated All such modifications and variations are within the scope of the invention as determined by the appended claims when interpreted in accordance with the breadth to which they are entitled.

What is claimed is:

1. An air mattress comprising:

a first set of first and second separate bladders aligned end to end along the length of the air mattress each with a width equal to a first half of the width of the air mattress;

a first inflation-deflation port member attached to the first separate bladder of the first set;

a tube having a first end attached to the first inflation-deflation port member which passes through the first bladder to feed air directly to the second bladder;

a first set of air openings located in the inflation-deflation port member around the perimeter of the first end of the tube which feeds air directly to the first bladder a second set of first and second separate bladders aligned end to end along the length of the air mattress each with a width equal to the second half of the width of the air mattress;

a second inflation-deflation port member attached to the first separate bladder of the second set;

a tube having a first end attached to the second inflation-deflation port member which passes through the first bladder of the second set to feed air directly to the second bladder; and a first set of air openings located in the second inflation-deflation port member around the perimeter of the first end of the tube which feeds air directly to the first bladder.

2. The air mattress of claim 1 wherein a plug is adapted to be coupled to each of the inflation-deflation port members to seal the first end of the tube and the set of openings located around the perimeter of the first end of the tube.

3. The air mattress of claim 2 wherein each plug is press fit into the inflation-deflation port members.

4. The air mattress of claim 3 wherein each bladder is made of a vinyl plastic.

5. The air mattress of claim 4 wherein each tube is made of a vinyl plastic.

6. The air mattress of claim 5 wherein each plug is made of rubber or a fluoro-elastomer plastic.

7. The air mattress of claim 6 wherein a cap is threaded onto each of the inflation-deflation port members to prevent removal of the plug.

8. The air mattress of claim 7 wherein the seams of and between each of the bladders are welded.

9. The air mattress of claim 8 wherein the four bladders are covered with a moisture absorption and reinforcement fabric.

10. The air mattress of claim 9 wherein the inflation-deflation port members and the cap are made of a polymer material.

11. An air mattress comprising:

a first set of first, second and third separate bladders aligned end to end along the length of the air mattress each with a width equal to a first half of the width of the air mattress;

a first inflation-deflation port member attached to the first separate bladder of the first set;

a first tube having a first end attached to the first inflation-deflation port member which passes through the first and second bladders to feed air directly to the third bladder;

a second tube located concentrically around the first tube having a first end attached to the first inflation-deflation port member which passes through the first bladder to feed air directly to the second bladder;

a set of air openings located in the inflation-deflation port member around the perimeter of the end of the second tube to feed air directly to the first bladder;

a second set of first, second and third separate bladders aligned end to end along the length of the air mattress each with a width equal to the second half of the width of the air mattress;

a second inflation-deflation port member attached to the first separate bladder of the second set;

a first tube having a first end attached to the second inflation-deflation port member which passes through the first and second bladders to feed air directly to the third bladder;

a second tube located concentrically around the first tube having an end attached to the second inflation-deflation port member which passes through the first bladder to feed air directly to the second bladder; and a set of air openings located in the second inflation-deflation port member around the perimeter of the end of the second tube to feed air directly to the first bladder.

12. The air mattress of claim 11 wherein a plug is adapted to be coupled to each of the inflation-deflation port members to seal the first end of the tube and the set of openings located around the perimeter of the first end of the tube.

13. The air mattress of claim 12 wherein each plug is press fit into the inflation-deflation port members.

14. The air mattress of claim 13 wherein each bladder is made of a vinyl plastic.

15. The air mattress of claim 14 wherein each tube is made of a vinyl plastic.

16. The air mattress of claim 15 wherein each plug is made of rubber or a fluoro-elastomer plastic.

17. The air mattress of claim 16 wherein a cap is threaded onto each of the inflation-deflation port members to prevent removal of the plug.

18. The air mattress of claim 17 wherein the seams of and between each of the bladders are welded.

19. The air mattress of claim 18 wherein the six bladders are covered with a moisture absorption and reinforcement fabric.

20. The air mattress of claim 19 wherein the inflation-deflation port members and the cap are made of a polymer material.

* * * * *